US009433819B1

(12) United States Patent
Carducci

(10) Patent No.: US 9,433,819 B1
(45) Date of Patent: Sep. 6, 2016

(54) TREADMILL WITH FOAM-SUPPORTED BELT AND ASSOCIATED METHOD

(71) Applicant: Nicola Carducci, Malibu, CA (US)

(72) Inventor: Nicola Carducci, Malibu, CA (US)

( * ) Notice: Subject to any disclaimer, the term of this patent is extended or adjusted under 35 U.S.C. 154(b) by 220 days.

(21) Appl. No.: 13/887,443

(22) Filed: May 6, 2013

(51) Int. Cl.
*A63B 22/02* (2006.01)

(52) U.S. Cl.
CPC ..... *A63B 22/0285* (2013.01)

(58) Field of Classification Search
CPC ..... A63B 22/0285; A63B 22/02; A63B 22/0207; A63B 22/0214; A63B 22/0221; A63B 22/0228; A63B 22/0235; A63B 22/0242; A63B 22/025; A63B 22/0257; A63B 22/0264; A63B 2022/0271; A63B 2022/0278; A63B 71/0054; A63B 2071/0063; A63B 2071/0072; A63B 22/0292
USPC ..... 119/700
See application file for complete search history.

(56) References Cited

U.S. PATENT DOCUMENTS 2,673,823 A * 3/1954 Biefeld ..... C03C 25/26 156/315
7,207,927 B2 * 4/2007 Chen ..... A63B 22/02 384/215
8,096,925 B2 * 1/2012 Radding et al. ..... 482/54
8,979,709 B2 * 3/2015 Toback ..... A63B 5/16 482/1
2004/0043873 A1 * 3/2004 Wilkinson et al. ..... 482/54
2005/0124471 A1 * 6/2005 Wilkinson ..... 482/121
2006/0205568 A1 * 9/2006 Huang ..... 482/54
2006/0287147 A1 * 12/2006 Kriesel ..... 474/237
2007/0015634 A1 * 1/2007 Ho et al. ..... 482/54
2009/0176628 A1 * 7/2009 Radding ..... A63B 22/02 482/54
2011/0152037 A1 * 6/2011 Wu ..... A63B 22/0207 482/54
2013/0130869 A1 * 5/2013 Hou et al. ..... 482/54
2013/0225371 A1 * 8/2013 Harrer et al. ..... 482/8
2013/0303334 A1 * 11/2013 Adhami ..... A63B 21/025 482/4

* cited by examiner

*Primary Examiner* — Loan H Thanh
*Assistant Examiner* — Megan Anderson

(57) ABSTRACT

A treadmill for relieving pressure on user joints during exercising operations includes a frame, a control panel attached to a top section of the frame, and a track attached to a bottom section of the frame. Notably, the track includes a rotatable belt formed from resilient material capable of absorbing impact forces exerted thereon to relieve pressure on the user joints. Such a rotatable belt includes inner and outer surfaces each formed from flexible and fluid-impermeable material, and a foam core intercalated between the inner surface. The foam core is formed from a resilient material capable of absorbing impact forces exerted thereon during an exercise regimen.

6 Claims, 3 Drawing Sheets

TREADMILL WITH FOAM-SUPPORTED BELT AND ASSOCIATED METHOD

CROSS REFERENCE TO RELATED APPLICATIONS

This application claims the benefit of U.S. Provisional Application No. 61/642,642 filed May 4, 2012, the entire disclosure of which is incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF NON-LIMITING EXEMPLARY EMBODIMENT(S) OF THE PRESENT DISCLOSURE

1. Technical Field

This disclosure relates to treadmills and, more particularly, to a treadmill having a foam-supported belt that provides a cushioned and force-absorbing layer for relieving stress exerted on a user's legs during use of the treadmill.

2. Prior Art

In 2005, over 50 million Americans spent more than $5 billion on exercise equipment—proving, if such a fact were in doubt, that exercise and fitness are not only big business, but a major concern to a great many people. Exercise equipment ranges from stair-climbing machines and elliptical trainers to rowing machines, free weights, cable-guided weight training machines, stationary bicycles, and treadmills. But while a first-rate treadmill offers some great features—varying speeds and inclines, timed courses with "hills" and "flats," all sorts of programmable options to tailor one's run to one's personal needs and goals—all of the treadmills currently on the market share one drawback, and that is the non-resilient, unforgiving nature of the tread itself, the belt-like surface that one runs on. Even with good running shoes, running on a hard surface like asphalt is hard on the feet, ankles, knees, and back; while running on a softer, more forgiving surface such as sod spares the body and its joints from harsh, jarring impacts and repetitive-stress injuries.

Conventional treadmills rely on a continuous belt which is driven in a continuous loop by motor-driven rollers, so that, as the belt moves from front to back, the runner runs, yet remains in place. But where the belts of other treadmills are thin, hard, and unforgiving, thereby exerting stress on a user's lower limbs.

Accordingly, a need remains for a treadmill having a foam-supported treadmill belt that provides a cushioned and force-absorbing layer to overcome prior art shortcomings. The present disclosure satisfies such a need by providing a combined treadmill and foam-supported treadmill belt that is convenient and easy to use, lightweight yet durable in design, versatile in its applications, and designed for relieving stress exerted on a user's legs during use of the treadmill.

BRIEF SUMMARY OF NON-LIMITING EXEMPLARY EMBODIMENT(S) OF THE PRESENT DISCLOSURE

In view of the foregoing background, it is therefore an object of the non-limiting exemplary embodiment(s) to provide a treadmill for relieving pressure on user joints during exercising operations. These and other objects, features, and advantages of the non-limiting exemplary embodiment(s) are provided by a treadmill including a frame, a control panel attached to a top section of the frame, and a track attached to a bottom section of the frame. Notably, the track includes a rotatable belt formed from resilient material capable of absorbing impact forces exerted thereon to relieve pressure on the user joints. Such a rotatable belt includes inner and outer surfaces each formed from flexible and fluid-impermeable material, and a foam core intercalated between the inner surface. The foam core is formed from a resilient material capable of absorbing impact forces exerted thereon during an exercise regimen.

In a non-limiting exemplary embodiment, each of the inner and outer surfaces has a thickness less than a thickness of the foam core.

In a non-limiting exemplary embodiment, the foam core has a single and unitary body entirely formed from the resilient material and directly engaged with each of the inner and outer surfaces.

In a non-limiting exemplary embodiment, the frame includes a free-standing platform supporting an underside of the track. First and second support legs are statically attached to the free-standing platform and extending upwardly therefrom. Such first and second support legs are coupled to the control panel. First and second support arms are statically attached to the control panel and extending downwardly away therefrom. Such first and second anchor rods are statically attached to the free-standing platform and extend upwardly away therefrom at an oblique angle directed towards distal ends of the first and second support arms, respectively. The first and second anchor rods are statically connected to the first and second support arms, respectively.

In a non-limiting exemplary embodiment, the frame further includes first and second anchor brackets directly connected to the first and second anchor rods as well as the first and second support arms, respectively. First and second stabilizing limbs statically are coupled to the first and second support arms as well as the first and second anchor brackets, respectively. Notably, the first and second anchor rods are maintained at a fixed position relative to the first and second support arms.

In a non-limiting exemplary embodiment, the first and second anchor brackets include first and second tubular portions slidably mounted about the first and second anchor rods, respectively. First and second elongated portions are directly attached to the first and second tubular portions, respectively. Such first and second elongated portions each have curvilinear faces conformed to exterior contours of the first and second anchor rods, respectively. In this manner, the curvilinear faces are directly abutted against the exterior contours of the first and second anchor rods, respectively.

In a non-limiting exemplary embodiment, the frame further includes first and second lower elastic bands having looped distal ends, respectively. First and second lower braces are attached to proximal ends of the first and second lower elastic bands, respectively. Notably, the first and second lower braces are coupled to medial portions of the first and second anchor rods, respectively.

In a non-limiting exemplary embodiment, the frame further includes first and second upper elastic bands having looped distal ends, respectively. First and second upper braces are attached to proximal ends of the first and second upper elastic bands, respectively. Notably, the first and second upper braces are coupled to medial portions of the first and second anchor rods, respectively.

In a non-limiting exemplary embodiment, the track includes a central region covered by the belt. First and second guide tracks are attached to opposed longitudinal sides of the central region capable of guiding the belt to rotate in a desired rotational direction.

The disclosure further includes a method of utilizing a treadmill for relieving pressure on user joints during exercising operations. Such a method includes the chronological steps of: providing a frame; providing and attaching a control panel to a top section of the frame; providing and attaching a track to a bottom section of the frame; and absorbing impact forces exerted on the track thereby relieving pressure on the user joints by providing the track with a rotatable belt formed from resilient material. Notably, the rotatable belt includes inner and outer surfaces each formed from flexible and fluid-impermeable material, and a foam core intercalated between the inner surface. Advantageously, the foam core is formed from a resilient material and thereby absorbing impact forces exerted thereon during an exercise regimen.

There has thus been outlined, rather broadly, the more important features of non-limiting exemplary embodiment(s) of the present disclosure so that the following detailed description may be better understood, and that the present contribution to the relevant art(s) may be better appreciated. There are additional features of the non-limiting exemplary embodiment(s) of the present disclosure that will be described hereinafter and which will form the subject matter of the claims appended hereto.

BRIEF DESCRIPTION OF THE NON-LIMITING EXEMPLARY DRAWINGS

The novel features believed to be characteristic of non-limiting exemplary embodiment(s) of the present disclosure are set forth with particularity in the appended claims. The non-limiting exemplary embodiment(s) of the present disclosure itself, however, both as to its organization and method of operation, together with further objects and advantages thereof, may best be understood by reference to the following description taken in connection with the accompanying drawings in which:

Figure 1:
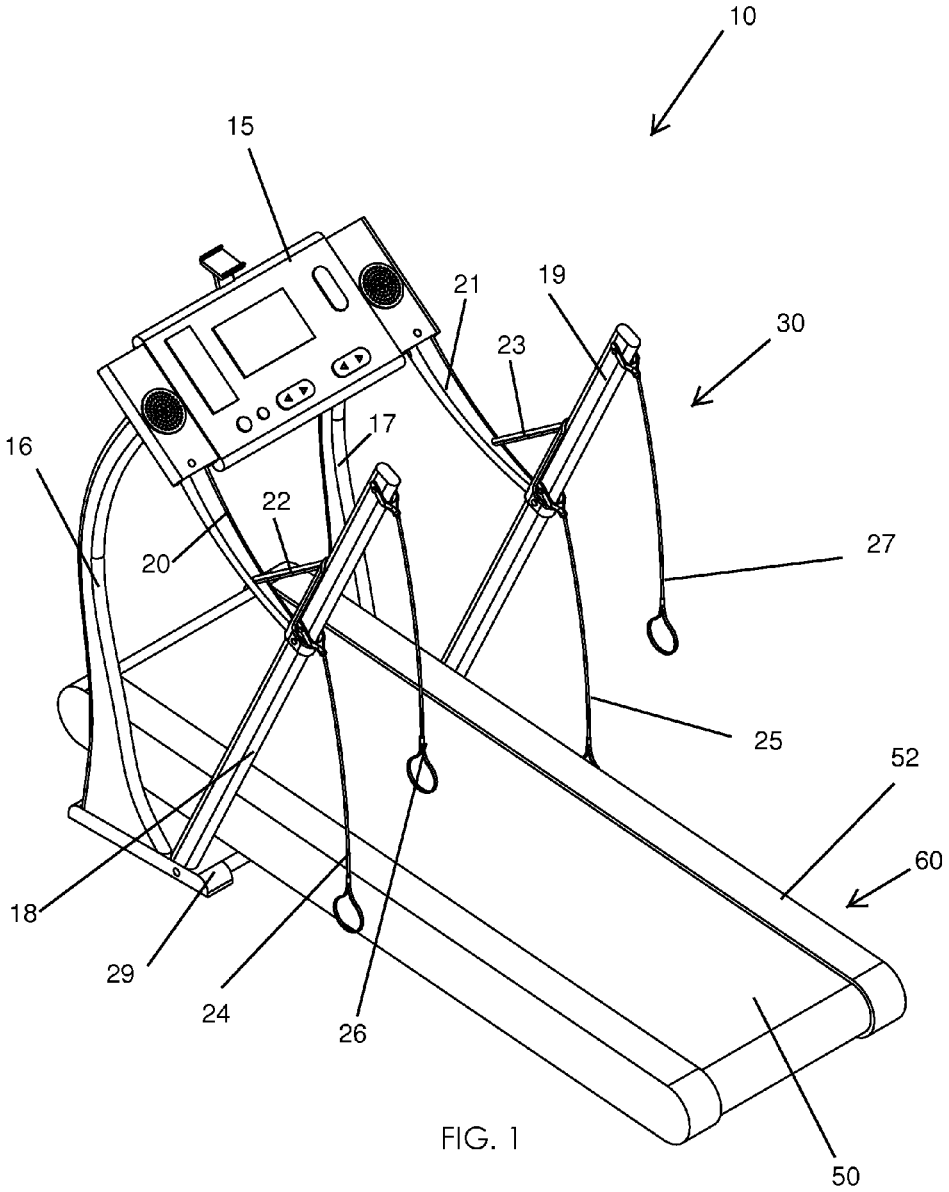
FIG. 1 is a perspective view showing a treadmill having a foam-supported treadmill belt, in accordance with the non-limiting exemplary embodiment(s)

Those skilled in the art will appreciate that the figures are not intended to be drawn to any particular scale; nor are the figures intended to illustrate every non-limiting exemplary embodiment(s) of the present disclosure. The present disclosure is not limited to any particular non-limiting exemplary embodiment(s) depicted in the figures nor the shapes, relative sizes or proportions shown in the figures.

DETAILED DESCRIPTION OF NON-LIMITING EXEMPLARY EMBODIMENT(S) OF THE PRESENT DISCLOSURE

The present disclosure will now be described more fully hereinafter with reference to the accompanying drawings, in which non-limiting exemplary embodiment(s) of the present disclosure is shown. The present disclosure may, however, be embodied in many different forms and should not be construed as limited to the non-limiting exemplary embodiment(s) set forth herein. Rather, such non-limiting exemplary embodiment(s) are provided so that this application will be thorough and complete, and will fully convey the true spirit and scope of the present disclosure to those skilled in the relevant art(s). Like numbers refer to like elements throughout the figures.

The illustrations of the non-limiting exemplary embodiment(s) described herein are intended to provide a general understanding of the structure of the present disclosure. The illustrations are not intended to serve as a complete description of all of the elements and features of the structures, systems and/or methods described herein. Other non-limiting exemplary embodiment(s) may be apparent to those of ordinary skill in the relevant art(s) upon reviewing the disclosure. Other non-limiting exemplary embodiment(s) may be utilized and derived from the disclosure such that structural, logical substitutions and changes may be made without departing from the true spirit and scope of the present disclosure. Additionally, the illustrations are merely representational are to be regarded as illustrative rather than restrictive.

One or more embodiment(s) of the disclosure may be referred to herein, individually and/or collectively, by the term "non-limiting exemplary embodiment(s)" merely for convenience and without intending to voluntarily limit the true spirit and scope of this application to any particular non-limiting exemplary embodiment(s) or inventive concept. Moreover, although specific embodiment(s) have been illustrated and described herein, it should be appreciated that any subsequent arrangement designed to achieve the same or similar purpose may be substituted for the specific embodiment(s) shown. This disclosure is intended to cover any and all subsequent adaptations or variations of other embodiment(s). Combinations of the above embodiment(s), and other embodiment(s) not specifically described herein, will be apparent to those of skill in the relevant art(s) upon reviewing the description.

References in the specification to "one embodiment(s)", "an embodiment(s)", "a preferred embodiment(s)", "an alternative embodiment(s)" and similar phrases mean that a particular feature, structure, or characteristic described in connection with the embodiment(s) is included in at least an embodiment(s) of the non-limiting exemplary embodiment(s). The appearances of the phrase "non-limiting exemplary embodiment" in various places in the specification are not necessarily all meant to refer to the same embodiment(s).

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiment(s) and are not necessarily intended to be construed as limiting.

Figure 2:
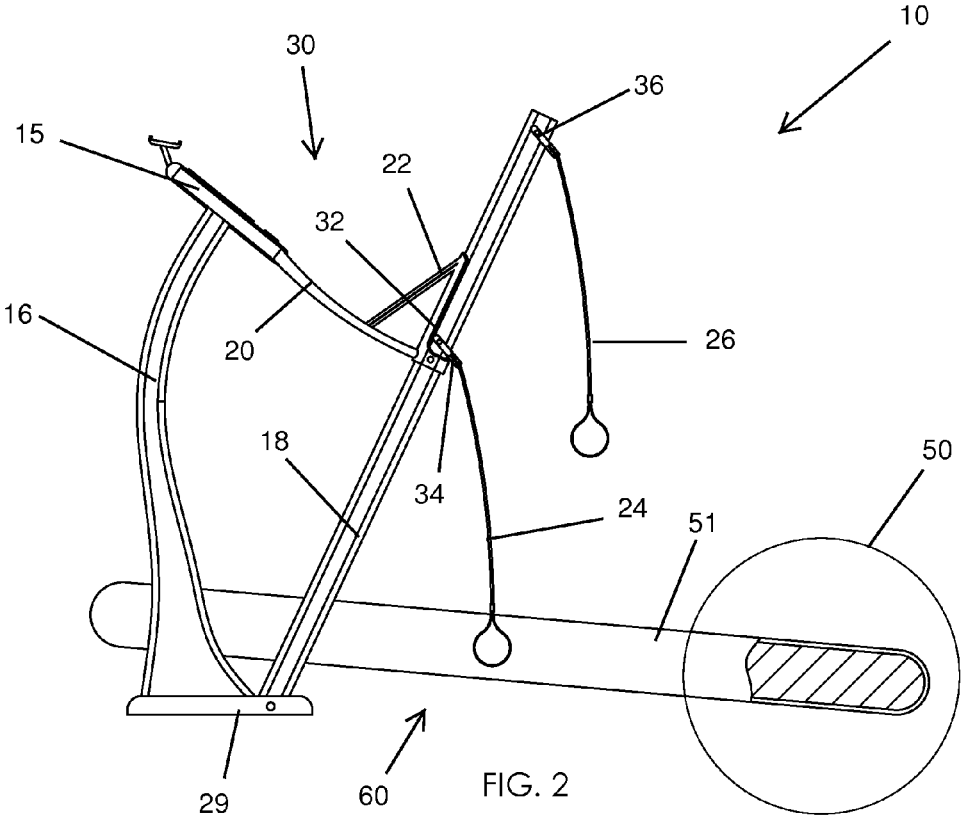
FIG. 2 is a side elevational view of the combined treadmill and foam-supported belt shown in FIG. 1.
Figure 3:
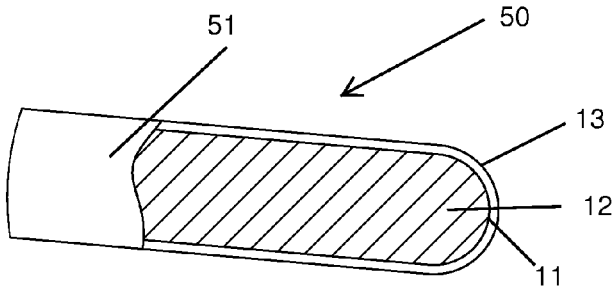
FIG. 3 is an enlarged broken-away view of a track and foam-supported belt section identified in FIG. 2.
Figure 4:
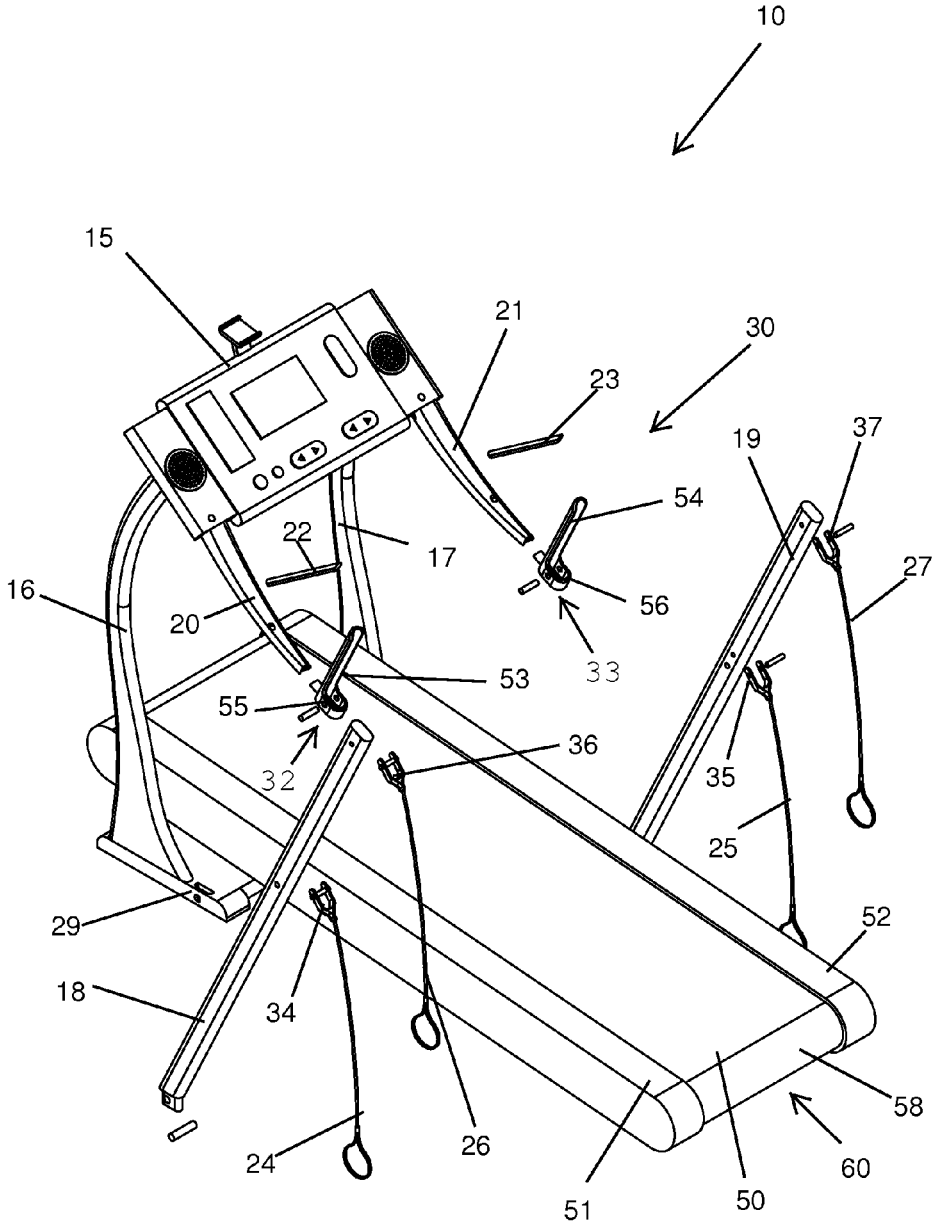
FIG. 4 is an exploded view of the combined treadmill with foam-supported treadmill belt shown in FIG. 1.

The non-limiting exemplary embodiment(s) is/are referred to generally in FIGS. 1-4 and is/are intended to provide a treadmill 10 having a foam-supported treadmill belt 50 that provides a cushioned and force-absorbing layer. It should be understood that such non-limiting exemplary embodiment(s) may be used to exercise many different types of muscle groups, and should not be limited to the uses described herein.

Referring to the figures in general, in a non-limiting exemplary embodiment, the treadmill 10 for relieving pressure on user joints during exercising operations, is disclosed. The treadmill 10 includes a frame 30, a control panel 15 attached to a top section of the frame 30, and a track 60 attached to a bottom section of the frame 30. Notably, the track 60 includes a rotatable belt 50 formed from resilient material capable of absorbing impact forces exerted thereon to relieve pressure on the user joints. Such a rotatable belt 50 includes inner and outer surfaces 11, 13, respectively, each formed from flexible and fluid-impermeable material, and a foam core 12 intercalated between inner surface 11.

In a non-limiting exemplary embodiment, the foam core 12 is formed from a resilient material capable of absorbing impact forces exerted thereon during an exercise regimen.

In a non-limiting exemplary embodiment, each of the inner and outer surfaces 11, 13 has a thickness less than a thickness of the foam core 12.

In a non-limiting exemplary embodiment, the foam core 12 has a single and unitary body entirely formed from the resilient material and directly engaged with each of the inner and outer surfaces 11, 13.

In a non-limiting exemplary embodiment, the frame 30 includes a free-standing platform 29 supporting an underside of the track 60. First and second support legs 16, 17 are statically attached to the free-standing platform 29 and extend upwardly therefrom. Such first and second support legs 16, 17 are coupled to the control panel 15. First and second support arms 20, 21 are statically attached to the control panel 15 and extend downwardly away therefrom. First and second anchor rods 18, 19 are statically attached to the free-standing platform 29 and extend upwardly away therefrom at an oblique angle directed towards distal ends of the first and second support arms 20, 21, respectively. The first and second anchor rods 18, 19 are statically connected to the first and second support arms 20, 21, respectively.

In a non-limiting exemplary embodiment, the frame 30 further includes first and second anchor brackets 32, 33 directly connected to the first and second anchor rods 18, 19 as well as the first and second support arms 20, 21, respectively. First and second stabilizing limbs 22, 23 are statically coupled to the first and second support arms 20, 21 as well as the first and second anchor brackets 32, 33, respectively. Notably, the first and second anchor rods 18, 19 are maintained at a fixed position relative to the first and second support arms 20, 21.

In a non-limiting exemplary embodiment, the first and second anchor brackets 32, 33 include first and second tubular portions 55, 56 slidably mounted about the first and second anchor rods 18, 19, respectively. First and second elongated portions 53, 54 are directly attached to the first and second tubular portions 55, 56, respectively. Such first and second elongated portions 53, 54 each have curvilinear faces conformed to exterior contours of the first and second anchor rods 18, 19, respectively. In this manner, the curvilinear faces are directly abutted against the exterior contours of the first and second anchor rods 18, 19, respectively.

In a non-limiting exemplary embodiment, the frame 30 further includes first and second lower elastic bands 24, 25 having looped distal ends, respectively. First and second lower elastic braces 34, 35 are attached to proximal ends of the first and second lower elastic bands 24, 25, respectively. Notably, the first and second lower elastic braces 34, 35 are coupled to medial portions of the first and second anchor rods 18, 19, respectively.

In a non-limiting exemplary embodiment, the frame 30 further includes first and second upper elastic bands 26, 27 having looped distal ends, respectively. First and second upper elastic braces 36, 37 are attached to proximal ends of the first and second upper elastic bands 26, 27, respectively. Notably, the first and second upper elastic braces 36, 37 are coupled to medial portions of the first and second anchor rods 18, 19, respectively.

In a non-limiting exemplary embodiment, the track 60 includes a central region 58 covered by the belt 50. First and second guide tracks 51, 52 are attached to opposed longitudinal sides of the central region 58 and are capable of guiding the belt 50 to rotate in a desired rotational direction.

The disclosure further includes a method of utilizing a treadmill 10 for relieving pressure on user joints during exercising operations. Such a method includes the chronological steps of: providing a frame 30; providing and attaching a control panel 15 to a top section of the frame 30; providing and attaching a track 60 to a bottom section of the frame 30; and absorbing impact forces exerted on the track 60 thereby relieving pressure on the user joints by providing the track 60 with a rotatable belt 50 formed from resilient material. Notably, the rotatable belt 50 includes inner and outer surfaces 11, 13 each formed from flexible and fluid-impermeable material, and a foam core 12 intercalated between inner surface 11. Advantageously, the foam core 12 is formed from a resilient material and thereby absorbing impact forces exerted thereon during an exercise regimen.

In a non-limiting exemplary embodiment, the treadmill belt 50 may be employed with a continuous-type treadmill 10 measuring approximately 8 feet in length by 2 feet in width, for example. Such dimensions may provide a more comfortable stride for users of any size and stature. Notably, a thickness of the belt 50, however, may be approximately 3 to 5 centimeters—approximately 1.2 to 2 inches—in depth, and include a soft thin rubber outer shell 11, 13 with an interior foam core 12. Such a structural configuration provides the runner's feet, ankles, knees, and back with a resilient, shock-absorbing surface, similar to grass, turf, or sod rather than hard and unforgiving pavement.

In a non-limiting exemplary embodiment, the foam core 12 may be formed from a memory-type, highly-absorbent and resilient foam; thus lessening the stress of repeated impacts on the feet, ankles, knees, hips, and back.

In an alternative embodiment, the outer shell 11, 13 of the treadmill belt 50 may be removably affixed to the foam core 12 thereby permitting a user to selectively change the foam core 12 based on the exercise regimen and type of exercise. For example, a thicker foam core 12 may be required for long endurance exercise regimens, whereas a thinner foam core 12 may be employed for short sprint exercise regimens.

While non-limiting exemplary embodiment(s) has/have been described with respect to certain specific embodiment(s), it will be appreciated that many modifications and changes may be made by those of ordinary skill in the relevant art(s) without departing from the true spirit and scope of the present disclosure. It is intended, therefore, by the appended claims to cover all such modifications and changes that fall within the true spirit and scope of the present disclosure. In particular, with respect to the above description, it is to be realized that the optimum dimensional relationships for the parts of the non-limiting exemplary embodiment(s) may include variations in size, materials, shape, form, function and manner of operation.

The Abstract of the Disclosure is provided to comply with 37 C.F.R. §1.72(b) and is submitted with the understanding that it will not be used to interpret or limit the scope or meaning of the claims. In addition, in the above Detailed Description, various features may have been grouped together or described in a single embodiment for the purpose of streamlining the disclosure. This disclosure is not to be interpreted as reflecting an intention that the claimed embodiment(s) require more features than are expressly recited in each claim. Rather, as the following claims reflect, inventive subject matter may be directed to less than all of the features of any of the disclosed non-limiting exemplary embodiment(s). Thus, the following claims are incorporated into the Detailed Description, with each claim standing on its own as defining separately claimed subject matter.

The above disclosed subject matter is to be considered illustrative, and not restrictive, and the appended claims are intended to cover all such modifications, enhancements, and other embodiment(s) which fall within the true spirit and scope of the present disclosure. Thus, to the maximum extent allowed by law, the scope of the present disclosure is to be determined by the broadest permissible interpretation of the following claims and their equivalents, and shall not be restricted or limited by the above detailed description.

What is claimed as new and what is desired to secure by Letters Patent of the United States is:

1. A treadmill for relieving pressure on user joints during exercising operations, said treadmill comprising:

a frame;

a control panel attached to said frame; and a track attached to a bottom section of said frame;

wherein said track includes a belt formed from resilient material capable of absorbing impact forces exerted thereon to relieve pressure on the user joints, said belt including inner and outer surfaces each formed from flexible and fluid-impermeable material, and a foam core being formed from a resilient material capable of absorbing impact forces exerted thereon during an exercise regimen;

wherein said foam core has a single and unitary body entirely formed from said resilient material;

wherein said belt directly wraps about said single and unitary body such that said foam core is intercalated between said belt;

wherein said frame comprises a free-standing platform supporting an underside of said track, first and second support legs statically attached to said free-standing platform and extending upwardly therefrom, said first and second support legs being coupled to said control panel, first and second support arms statically attached directly to said control panel and extending downwardly away therefrom, and first and second anchor rods statically attached to said free-standing platform and extending upwardly away therefrom at an oblique angle directed towards distal ends of said first and second support arms, respectively;

wherein said first and second anchor rods are statically connected to said first and second support arms, respectively;

wherein said first anchor rod has a bottom end attached directly to said free-standing platform at a front end of said frame and spaced from a rear end of said track;

wherein each of said first and second anchor rods has a top end facing away from said front end of said frame and terminating above said first and second support arms;

wherein said frame further comprises first and second anchor brackets directly connected to said first and second anchor rods as well as said first and second support arms, respectively;

first and second stabilizing limbs statically coupled to said first and second support arms as well as said first and second anchor brackets, respectively;

wherein said first and second anchor rods are maintained at a fixed position relative to said first and second support arms.

2. The treadmill of claim 1, wherein said first and second anchor brackets comprise:

first and second tubular portions slidably mounted about said first and second anchor rods, respectively; and first and second elongated portions directly attached to said first and second tubular portions, respectively;

wherein said first and second elongated portions each have curvilinear faces conformed to exterior contours of said first and second anchor rods, respectively;

wherein said curvilinear faces are directly abutted against said exterior contours of said first and second anchor rods, respectively.

3. The treadmill of claim 1, wherein said frame further comprises:

first and second lower elastic bands having looped distal ends, respectively; and first and second lower braces attached to proximal ends of said first and second lower elastic bands, respectively;

wherein said first and second lower braces are coupled to medial portions of said first and second anchor rods, respectively;

wherein said first and second lower elastic bands extend away from said front end of said frame and a front end of said track;

wherein said first and second lower elastic bands further extend towards a rear end of said track;

wherein said looped ends of said first and second lower elastic bands extend away from said control panel, said front end of said frame and said front end of said track.

4. The treadmill of claim 1, wherein said frame further comprises:

first and second upper elastic bands having looped distal ends, respectively; and first and second upper braces attached to proximal ends of said first and second upper elastic bands, respectively;

wherein said first and second upper braces are coupled to medial portions of said first and second anchor rods, respectively;

wherein said first and second upper elastic bands extend away from said front end of said frame and a front end of said track;

wherein said first and second upper elastic bands further extend towards a rear end of said track;

wherein said looped ends of said first and second upper elastic bands extend away from said control panel, said front end of said frame and said front end of said track.

5. The treadmill of claim 1, wherein said track comprises:

a central region covered by said belt; and first and second guide tracks attached to opposed longitudinal sides of said central region capable of guiding said belt to rotate in a desired rotational direction.

6. A method of utilizing a treadmill for relieving pressure on user joints during exercising operations, said method comprising the chronological steps of:

providing a frame;

providing and attaching a control panel to a top section of said frame;

providing and attaching a track to a bottom section of said frame; and absorbing impact forces exerted on said track thereby relieving pressure on the user joints by providing said track with a rotatable belt formed from resilient material;

wherein said rotatable belt includes inner and outer surfaces each formed from flexible and fluid-impermeable material, and a foam core intercalated between said inner surface;

wherein said foam core is formed from a resilient material and thereby absorbing impact forces exerted thereon during an exercise regimen;

wherein said foam core has a single and unitary body entirely formed from said resilient material;

wherein said belt directly wraps about said single and unitary body such that said foam core is intercalated between said belt;

wherein said frame comprises a free-standing platform supporting an underside of said track, first and second support legs statically attached to said free-standing platform and extending upwardly therefrom, said first and second support legs being coupled to said control panel, first and second support arms statically attached directly to said control panel and extending downwardly away therefrom, and first and second anchor rods statically attached to said free-standing platform and extending upwardly away therefrom at an oblique angle directed towards distal ends of said first and second support arms, respectively;

wherein said first and second anchor rods are statically connected to said first and second support arms, respectively;

wherein said first anchor rod has a bottom end attached directly to said free-standing platform at a front end of said frame and spaced from a rear end of said track;

wherein each of said first and second anchor rods has a top end facing away from said front end of said frame and terminating above said first and second support arms;

wherein said frame further comprises first and second anchor brackets directly connected to said first and second anchor rods as well as said first and second support arms, respectively;

first and second stabilizing limbs statically coupled to said first and second support arms as well as said first and second anchor brackets, respectively;

wherein said first and second anchor rods are maintained at a fixed position relative to said first and second support arms.

* * * * *